US005544721A

United States Patent [19]

Roberts

[11] Patent Number: 5,544,721

[45] Date of Patent: Aug. 13, 1996

[54] METHOD AND APPARATUS FOR ADJUSTING AN ELEVATOR CAR BASED ON STORED HORIZONTAL DISPLACEMENT AND ACCELERATION INFORMATION

[75] Inventor: Randall K. Roberts, Amston, Conn.

[73] Assignee: Otis Elevator Company, Farmington, Conn.

[21] Appl. No.: 279,826

[22] Filed: Jul. 25, 1994

Related U.S. Application Data

[63] Continuation of Ser. No. 67,414, May 25, 1993, abandoned, which is a continuation of Ser. No. 668,546, Mar. 13, 1991, abandoned.

[51] Int. Cl.[6] ..... B66B 1/44

[52] U.S. Cl. ..... 187/394; 187/292; 187/391

[58] Field of Search ..... 187/1 R, 100, 187/95, 115, 130, 133, 391, 393, 394, 409, 410, 277, 292

[56] References Cited

U.S. PATENT DOCUMENTS

| | | | |
|---|---|---|---|
| 3,871,301 | 3/1975 | Kolm et al. . | |
| 3,939,778 | 2/1976 | Ross et al. . | |
| 4,215,403 | 7/1980 | Pollard et al. . | |
| 4,507,738 | 3/1985 | Nozawa et al. | 364/474.29 |
| 4,617,502 | 10/1986 | Sakane et al. | 318/568.18 |
| 4,621,833 | 11/1986 | Soltis . | |
| 4,625,993 | 12/1986 | Williams et al. . | |

(List continued on next page.)

FOREIGN PATENT DOCUMENTS

| | | | |
|---|---|---|---|
| 58-39753 | 9/1983 | Japan . | |
| 60-15374 | 1/1985 | Japan . | |
| 60-36279 | 2/1985 | Japan . | |
| 61-22675 | 6/1986 | Japan . | |
| 63-87483 | 4/1988 | Japan . | |
| 1-156293 | 6/1989 | Japan . | |
| 1-197294 | 8/1989 | Japan . | |
| 1-321283 | 12/1989 | Japan | B66B 7/02 |
| 1-321285 | 12/1989 | Japan | B66B 7/02 |
| 3-23185 | 1/1991 | Japan . | |
| 3-3884 | 1/1991 | Japan . | |
| 3-3888 | 1/1991 | Japan . | |
| 3-51281 | 3/1991 | Japan . | |
| 3-51280 | 3/1991 | Japan . | |
| 3-51279 | 3/1991 | Japan . | |
| 3-115076 | 5/1991 | Japan . | |
| 3-124683 | 5/1991 | Japan | B66B 7/02 |
| 2181275 | 4/1987 | United Kingdom . | |

OTHER PUBLICATIONS

"Inertial Profilometer as a Rail Surface Measuring Instrument", T. Rudd et al, contributed by the Intersociety Committee on Transportation for presentation at the Intersociety Conference on Transportation, Denver, Colo., Sep. 23–27, 1973.

Database WPIL, Week 9030, Derwent Publications Ltd., London, GB; AN 90–224718 and FI–A–8804380.

"Development of an Inertial Profilometer" by E. L. Brandenburg, et al, ENSCO, Inc., prepared for the Federal Railroad Administration in Nov. 1974 and distributed by the National Technical Information Service.

"Riding on Electrons", by D. Sherman, *Popular Science* Sep. 90.

"A Magnetic Bearing Control Approach Using Flux Feedback" by N. J. Groom, NASA Technical Memo. 100672, Mar. 1989.

"Performance of Magnetic Suspensions for High Speed Vehicles Operating over Flexible Guideways", by C. A. Skalski, *Transactions of the ASME,* Jun. 1974.

*Primary Examiner*—Peter S. Wong
*Assistant Examiner*—Robert Nappi
*Attorney, Agent, or Firm*—Francis J. Maguire

[57] ABSTRACT

Elevator horizontal vibrations are actively controlled by retrieving data stored in memory indicative of the out-of-straightness of the elevator car's guide rails. The stored data is compiled during a learning run by summing the car's relative displacement with respect to the rail with a doubly integrated acceleration signal indicative of the car's deviation from true vertical.

6 Claims, 11 Drawing Sheets

U.S. PATENT DOCUMENTS

| | | | |
|---|---|---|---|
| 4,750,590 | 6/1988 | Otala | 187/95 |
| 4,754,849 | 7/1988 | Ando . | |
| 4,770,438 | 9/1988 | Sugasawa et al. . | |
| 4,809,179 | 2/1989 | Klinger et al. . | |
| 4,892,328 | 1/1990 | Kurtzman et al. . | |
| 4,898,257 | 2/1990 | Brandstadter . | |
| 4,899,852 | 2/1990 | Salmon et al. | 187/1 R |
| 4,909,535 | 3/1990 | Clark et al. . | |
| 5,020,639 | 6/1991 | Michel | 187/1 R |
| 5,027,925 | 7/1991 | Kahkipuro | 187/115 |
| 5,086,882 | 2/1992 | Sugahara et al. | 187/95 |
| 5,308,938 | 5/1994 | Roberts et al. | 187/115 |
| 5,321,217 | 6/1994 | Traktovenko et al. | 187/115 |
| 5,322,144 | 6/1994 | Skalski et al. | 187/115 |
| 5,329,077 | 7/1994 | Skalski et al. | 187/133 |

METHOD AND APPARATUS FOR ADJUSTING AN ELEVATOR CAR BASED ON STORED HORIZONTAL DISPLACEMENT AND ACCELERATION INFORMATION

This is a continuation of Ser. No. 08/067,414 filed on May 25, 1993 now abandoned which is a continuation of application Ser. No. 07/668,546 filed on Mar. 13, 1991 now abandoned.

CROSS-REFERENCE TO RELATED APPLICATION

This application discloses subject matter which may be disclosed and claimed in copending application U.S. Ser. No. 07/668,544 filed on Mar. 13, 1991.

TECHNICAL FIELD

This invention relates to elevators and, more particularly, to ride quality.

BACKGROUND ART

Maintaining or improving the ride quality of elevators will require implementation of new technologies, especially as the elevator speeds are increased. Reducing lateral motion of the car platform is important for improving ride quality. Such motion can be caused by rail-induced forces which are transmitted to the car through the rail guides due to rail irregularities.

If one were to design an automatic control system for reducing such lateral motion one could choose an open loop system.

At least one attempt to address rail-induced forces using an open loop control is shown in the literature. In U.S. Pat. No. 4,750,590, in order to compensate for lateral oscillation of an elevator car, Matti Otala discloses what appears to be an open-loop elevator control system with solenoid actuated guide shoes. The disclosure purports to show how to use the concept of first ascertaining the out-of-straightness of the guide rails for storage in a computer memory and subsequently controlling the guide shoes by recalling the corresponding information from memory and correcting the guide rail shoe positions accordingly.

However, the method shown in Otala's disclosure, of merely attaching acceleration meters to the elevator car, would not, as suggested by his disclosure, provide sufficient information to create a "deviation table" for a compensation system. It would merely create an acceleration table. How a "deviation table" is made from acceleration meters; is not shown or suggested.

There are two principal disturbances which contribute to the levels of vibration in the car: (1) rail-induced forces which are transmitted to the car through the rail guides due to rail irregularities, and (2) direct-car forces such as produced by wind buffeting, passenger load, distribution or motion.

The various parameters of the elevator car's suspension system are so affected by unrepeatable direct-car forces that the underlying acceleration measurements, without more, would not be meaningful. In other words, the underlying accelerations are a nonlinear function of the car load, its distribution, the movement of passengers, and a myriad of other direct car forces. Something more is needed to interpret the sensed acceleration signals (or deviations integrated therefrom) in a meaningful context in order to be enabled to compile a displacement table that truly reflects the rail profile.

DISCLOSURE OF INVENTION

On the other hand, the teachings herein show why it is necessary, and how to actually quantify, the cause of the first system disturbance, i.e., elevator guide rail irregularities.

According to my aforementioned application, horizontal rail deviations from vertical are measured by relating a sensed car horizontal acceleration signal to a sensed signal indicative of the horizontal displacement of the car from the rail.

In said copending application, a sensed signal indicative of horizontal acceleration of an elevator car may be doubly integrated to provide a first displacement signal indicative of the horizontal displacement of the car with respect to an inertial reference system. A concurrently sensed, second displacement signal indicative of the displacement of the car with respect to a hoistway rail may be summed with the first displacement signal. The summed signal may be paired with a vertical position signal indicative of the position of the car in the hoistway at the time of the concurrent measurements and stored for later use.

In accordance with the present invention, elevator vertical position in a hoistway is used to select rail profile data previously stored in a lookup table, i.e., stored according to the method described in the previous two paragraphs, to anticipate rail irregularities that would otherwise cause horizontal translations that can be prevented using actuators in an open loop control system.

The aforementioned co-pending application discloses a novel means and method to quantify elevator guide rail irregularities by storing data gathered in the manner taught therein. This invention relates to retrieving particular data according to the vertical position of the car in the hoistway to effectively ameliorate rail irregularities in an open-loop, active suspension system.

Thus, the "rail profile estimation approach" disclosed herein and also disclosed and claimed in the co-pending application can be used to generate a profile of guide rails, that is, a graph, data base, lookup table, or the like, of rail displacement versus elevator vertical position for use in an open-loop control system. The disclosed active suspension concepts may be used on new elevators or may be retrofitted to existing installations.

The active suspension system disclosed in this application is unique in that it provides a means for improving ride quality without an expensive closed-loop system, i.e., minimizing additional equipment required by avoiding extra sensors and relying instead only on a vertical position measurement of the car in the hoistway.

The disclosed active system may be used to reduce lateral car vibration levels by up to approximately 90%. Such compensation may be employed on new equipment or retrofitted to existing installations. The disclosed method has been validated as being highly robust and repeatable across a wide spectrum of speeds, directions, suspension stiffnesses, suspension preloads and car payloads.

These and other objects, features and advantages of the present invention will become more apparent in light of the following detailed description of a best mode embodiment thereof, as illustrated in the accompanying drawing.

BRIEF DESCRIPTION OF THE DRAWING

FIGS. 10(*b*), 11(*b*), & 12(*b*) show a horizontal car position with respect to the rail vs. car vertical position for a car load of 228 kilograms located, respectively, at the cab floor center, 94 centimeters to the left of center and 94 centimeters to the right of center, according to the present invention;

FIGS. 10(*c*), 11(*c*) & 12(*c*) show estimated car deviation from true vertical, being doubly integrated and filtered versions of the acceleration plots of FIGS. 10(*a*), 11(*a*) & 12(*a*), respectively, according to the present invention;

FIGS. 10(*d*), 11(*d*) & 12(*d*) show estimated rail profiles vs. car vertical position which may be obtained by summing the signals of FIGS. 10(*b*), 11(*b*) & 12(*b*) with those of FIGS. 10(*c*), 11(*c*) & 12(*c*), respectively, according to the present invention;

BEST MODE FOR CARRYING OUT THE INVENTION

Figure 1:
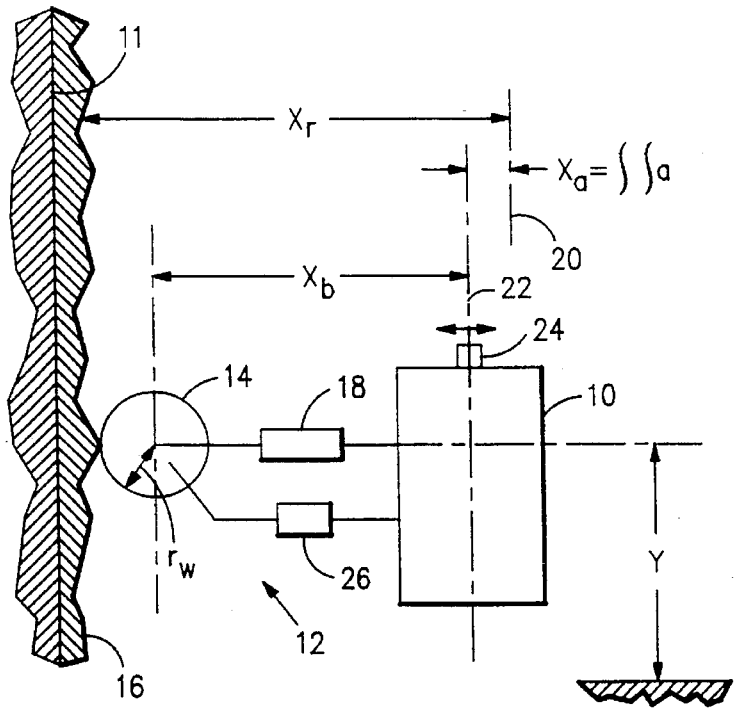
FIG. 1 illustrates some of my rail estimation concepts for an elevator car having a roller guide.

FIG. 1 illustrates a central teaching of the present rail estimation invention as carried out on an elevator using conventional wheel guides. It should be understood, however, that the teachings hereof are applicable to other types of guides as well and are not restricted to merely roller guide-type installations. An elevator car 10 for travelling up and down vertically as indicated by a vertical distance y in a hoistway is shown having a wheel guide 12 with a wheel 14 for riding on a rail 16 attached to a hoistway wall 11 and a spring 18 attached at one end to the wheel and the other to the car. Although this teaching is illustrated for side to side horizontal translations, it will be realized that the same basic principle is applicable to front to back translations as well.

With the car at rest, a horizontal distance $x_a$ between a vertical reference line 20, e.g., a vertical inertial reference or "plumb line" down the center of the hoistway, and a vertical centerline 22 of the car can be defined to zero. However, assuming the opposite rail is completely smooth, during vertical motion of the car, due to direct and rail induced forces, the car will experience various horizontal translations which will cause the distance $x_a$ to be nonzero. The magnitude of $x_a$ may be measured, e.g., using an accelerometer 24 and doubly integrating its output signal (a).

The horizontal translations will cause a distance $x_b$ between the wheel and the car to change and the magnitude of $x_b$ may be measured using a position sensor 26. It may be assumed that the wheel is relatively incompressible and has sufficient preload to prevent loss of contact with the rail during elevator operation. Thus, the summation of $x_a$ and $x_b$ will represent the deviation of the rail's surface from the reference line 20:

$$x_r = x_a + x_b + r_w,$$

where, $x_r$=rail displacement, $x_a$=car displacement, $x_b$=relative wheel to car displacement, and $r_w$=effective wheel radius (constant).

In this way, an actual rail deviation table may be compiled. The table will be indicative of rail displacement from a true vertical reference line.

Figure 2:
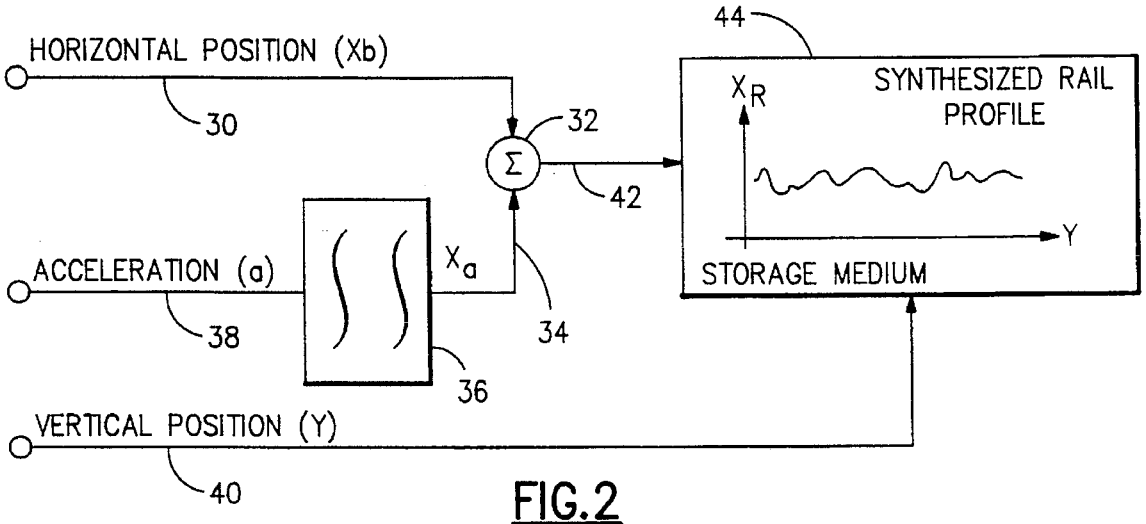
FIG. 2 shows a method of relating a sensed car acceleration signal to sensed horizontal and vertical displacement signals.

FIG. 2 illustrates a way to make such a rail deviation table. A horizontal position signal on a line 30 from a position sensor such as sensor 26 is summed in a summing junction 32 with another position signal on a line 34 from a signal conditioner 36 which double integrates an acceleration signal on a line 38 from an accelerometer such as the accelerometer 24. A vertical position signal on a line 40 indicative of the car's vertical position in the hoistway is provided, along with a summation signal on a line 42, to be paired therewith to form a table of positional data indicative of the magnitude of horizontal rail deviation from true vertical along the hoistway. An analog representation of such a table is shown in a box 44 by way of a graph on a Cartesian coordinate system although it should be realized that the table will typically be stored by way of samples in a digital memory for access by a digital signal processor.

Figure 3:
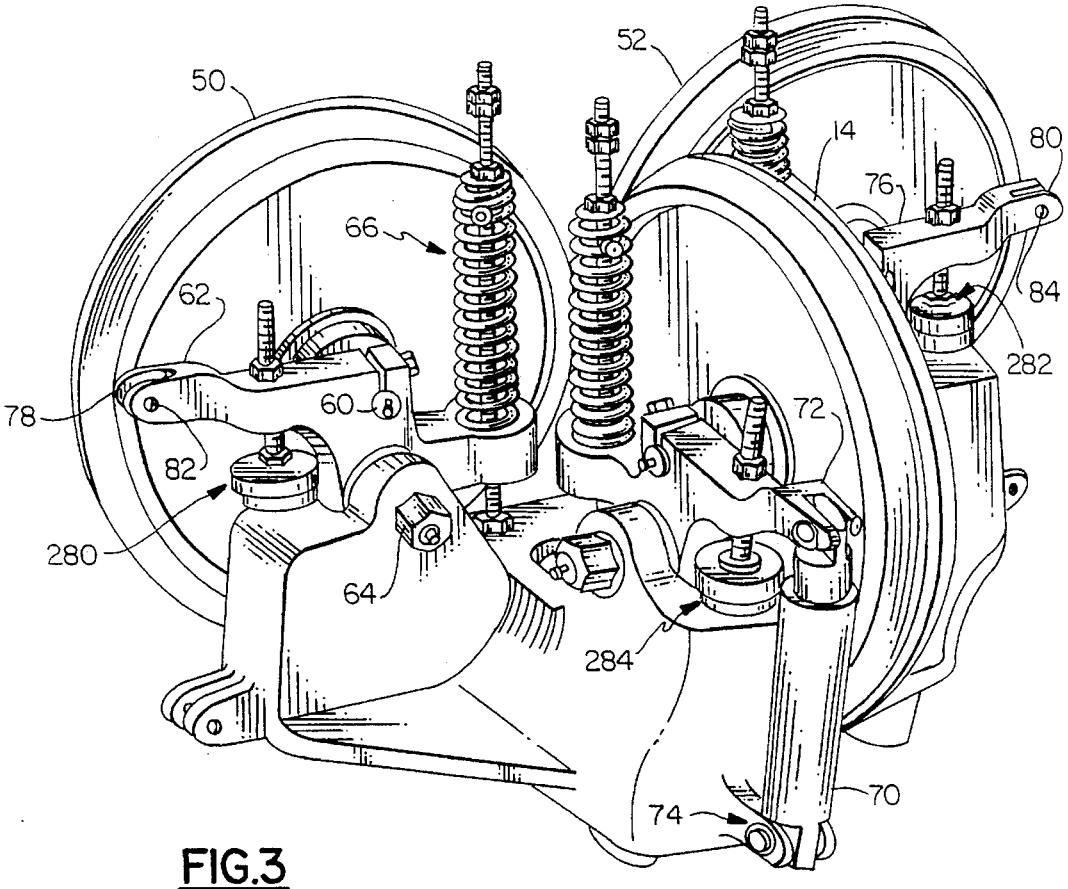
FIG.3 Prior Art
FIG. 3 shows a prior art roller guide.
Figure 4:
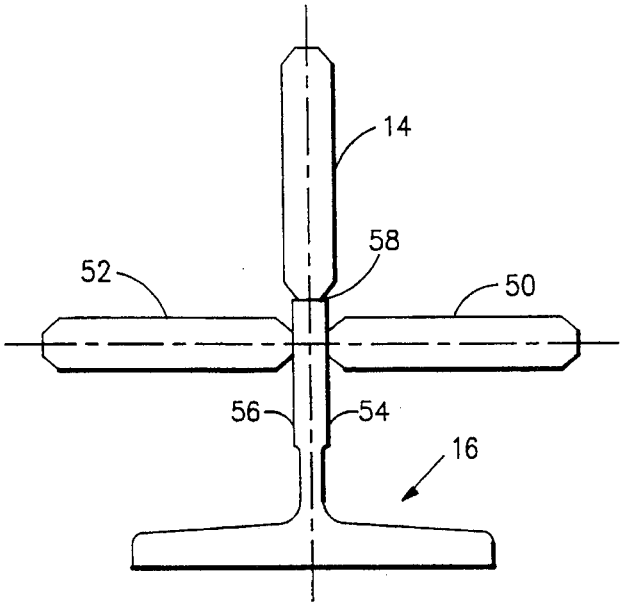
FIG.4 Prior Art
FIG. 4 shows the rollers of FIG. 3 from above as they would typically be situated on a rail.

A car may be instrumented to measure the side to side displacement $x_b$ depending on the type of guide. For an example of a typical guide, FIG. 3 shows a ten inch (25.4 cm) Otis roller guide 48 which may be found installed on numerous high speed elevators throughout the world. The guide is fixedly mounted on a car and front and back rollers 50, 52 roll on opposite faces 54, 56, respectively, of the hoistway rail 16, as shown in FIGS. 1 & 4 adjacent the car. The side to side roller 14 rolls on a distal face 58 of the rail.

The front to back roller 50 has its axle fixedly attached at a point 60 to an arm 62 which rotates about a point 64. An adjustable spring 66 preloads the roller 50 to exert a selected force against rail face 54. Rollers 52, 14 are set up similarly to roll on faces 56, 58, respectively. A side-to-side dashpot 70 is shown connected between an arm 72 and a bracket 74. The original design of the roller guide as shown in FIG. 3 made similar provision for front-to-back dashpot for the arm 62 and an arm 76 but the dashpots, at least for some cases, were apparently later found to be unnecessary. Consequently, at least some later versions were manufactured without openings and holes for the dashpot 70 as well as without the openings 78, 80 and the holes 82, 84. See U.S. Pat. No. 3,099,334 to Tucker issued Jul. 30, 1963 for more details.

It will be realized that the particular guide shown is not the only type of guide which may be instrumented to measure the relative displacement between the car and rail. Other types of rails such as sliding guides, electromagnet guides and many other types of guides are certainly within the scope of the invention. It is only necessary to instrument the selected type of guide in such a way as to measure the relative displacement between the car and rail.

Figure 5:
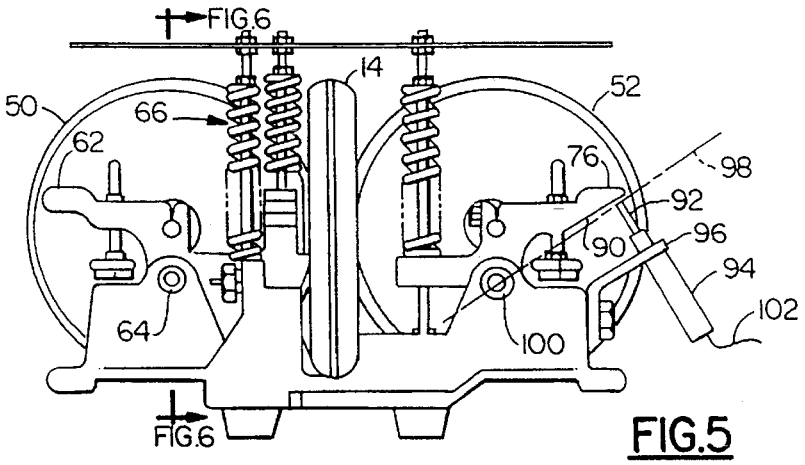
FIG. 5 shows the roller guide of FIG. 3 instrumented for measuring front-to-back displacement of the car from a rail, according to the present invention.

FIG. 5 shows a sectional view of the wheel guide of FIG. 3 from the rear. The underside of arm 76 (without a through hole 84 or slot 80) is machined down to a planar surface 90 for sliding contact with a plunger 92 of a displacement transducer 94 mounted on a bracket 96 affixed to the body of the guide. If a line 98 in the plane 90 were extended as shown it would intersect a pivot point 100 for wheel 52 similar to pivot point 64 already described with respect to wheel 50. By setting up this geometry, one can readily linearize any test readings obtained to relate actual wheel displacement to measured rocker arm movement. For example, a shim of a certain thickness inserted between the wheel 52 and the rail face 56, temporarily disconnecting spring 60, might result in a displacement of the plunger 92 by a measurable factor of that thickness, for example, approximately twice. Any inaccuracy introduced by the sliding action of the tip of the plunger 92 against the surface 90 may be neglected. A signal on a line 102 from the sensor 92, 94 is provided.

Figure 6:
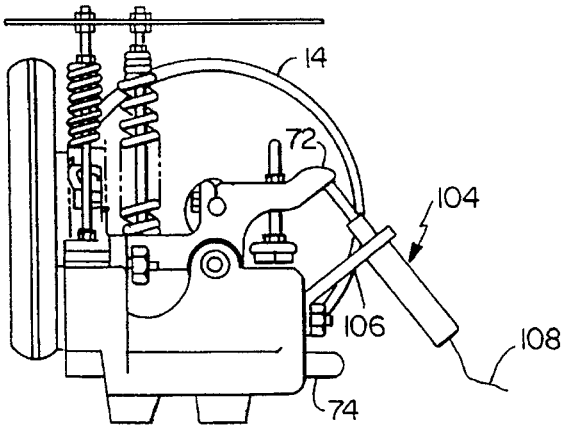
FIG. 6 shows the roller guide of FIG. 3 instrumented for measuring side-to-side displacement of the car from a rail, according to the present invention.

FIG. 6 is a side sectional view as shown in FIG. 5 from the left of the guide of FIG. 3, instrumented for measuring side-to-side displacement of the car relative to the rail. A displacement sensor 104 is mounted in a way similar to that described above for sensor 92, 94 on a bracket 106 attached to the guide body for providing a signal on a line 108 indicative of the displacement of the car from the rail surface 58.

It will be observed that the instrumentation of FIG. 5 provides for measuring the front to back displacement only of the deviation of rail surface 56 and not that of its opposite 54. This assumes uniform thickness of the rail which is an acceptable assumption.

Figure 8:
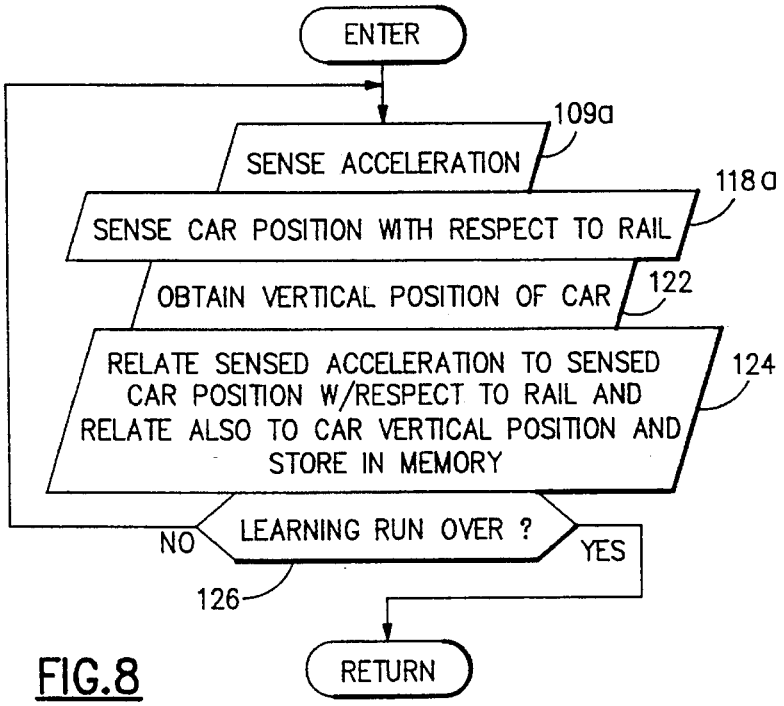
FIG. 8 illustrates steps suitable for execution on a digital signal processor, such as is shown in FIG. 7, for estimating a rail profile along a single axis, according to the present invention.
Figure 7:
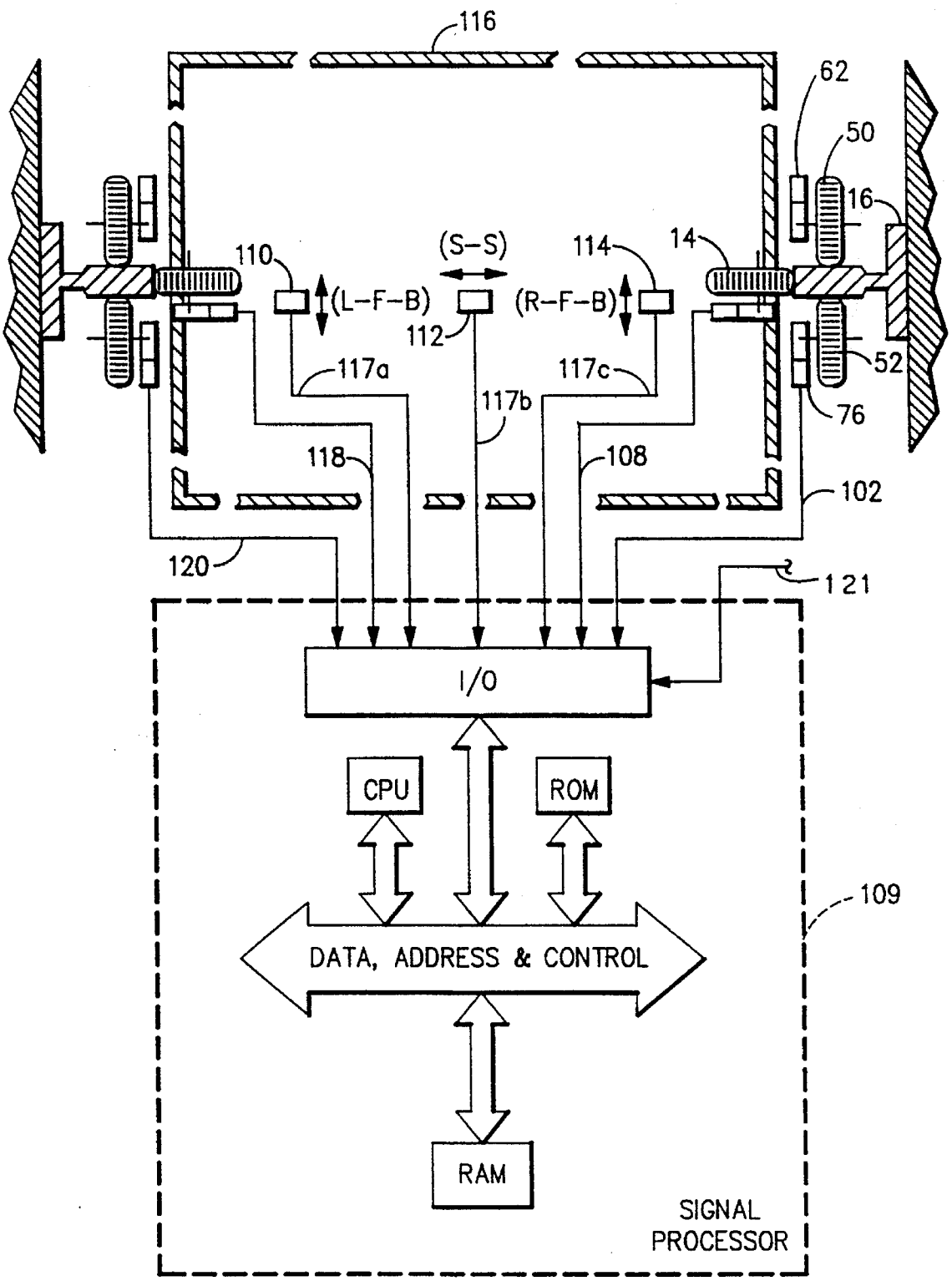
FIG. 7 is an illustration of rail estimation hardware, according to the present invention.

FIG. 7 is an illustration of rail estimation hardware which may be used for carrying out the rail estimation method, according to the present invention. Although the embodiment shown is for gathering a plurality of rail profiles, it should be realized that, in essence, the invention applies to rail estimation in a single axis as shown in FIG. 1, which may of course be practiced, as shown in FIG. 7, in several axes at the same time. The hardware shown in FIG. 7 includes a signal processor 109 which is provided in order to carry out four basic steps as illustrated in FIG. 8:

(1) Acceleration Sensing. This may be accomplished, as indicated in a step 109*a*, by using one or more accelerometers depending on the number of profiles to be gathered, for example, three accelerometers 110, 112, 114, located, e.g., at either the top (shown) or bottom of an elevator car frame 116 oriented to measure, respectively, left front-to-back (l-f-b) acceleration as indicated by a signal on a line 117*a*, side-to-side (s-s) acceleration as indicated by a signal on a line 117*b* and right front-to-back (r-f-b) acceleration as indicated by a signal on a line 117*c;*

(2) Sensing Car Position With Respect To Rail. Using, for example, one or more relative position sensors, as indicated in a step 118*a*, in this case four sensors 92, 94; 104 (as shown previously in FIGS. 5 & 6; not shown explicitly in FIG. 7 because the rocker arms, e.g., 62, 76 obscure them in the plan view shown) on the roller guide on the right of the Figure and two others (also not shown) for the left guide, used as relative displacement transducers (e.g., LVDTs, linear potentiometers, gap sensors or the like), for both s-s and f-b displacement measurement at each guide and providing a left side-to-side displacement signal on a line 118, a left front-to-back displacement signal on a line 120, the right side-to-side displacement signal on the line 108, and the right front-to-back displacement signal on the line 102;

(3) Obtaining Vertical Position of Car. An indication or measure of the vertical car position is required, such as by means of assignee's Primary Position Transducer (see U.S. Pat. No. 4,384,275 to Masel et al) or some other manufacturer's vertical position indicating or measured position signal, on a line 121 (FIG. 7) as indicated in a step 122, and (4) Relating Sensed Acceleration to Sensed Car Position with respect to the Rail To Obtain Rail Displacement from Vertical. As indicated by a step 124, the signal processor 109, data collection computer or the like is used to record the concurrent acceleration, car horizontal position with respect to the rail and car vertical position signals and to process data in such signals using the rail estimation methods disclosed above or in more detail below.

As indicated in a step 126, a decision is made as to whether the car has as yet traversed the full length of the hoistway. If not, the steps 109*a*, 118*a*, 122, 124, 126 are executed again until such time as the rail profile has been obtained.

With regard to the number and positioning of accelerometers, it should be understood that the number and positioning shown is a matter of choice since the acceleration of any point on a plane in the car may theoretically be inferred from merely three accelerometers in that plane. Three accelerometers are shown, one in the center and two on either side near the guides as a matter of computational choice, in this particular case dictated by the decision to treat the left and right front-to-back translations independently of each other. That decision dictated further that they should be placed relatively close to the guides. It should be understood, however, that one could use two such accelerometers together, even placed differently, as manifestations of a single, rotational acceleration (yaw) about a vertical axis. A rotational sensor could even be used.

Similarly, although a particular arrangement and choice of position sensors is shown, it should be realized that other types and arrangements may be used as well. For example, if it is desired to establish a rail profile for a system in which a pure electromagnet actuator is normally fixedly attached to the car with a variable gap between it and the rail, a gap sensor may be used to detect the variations in the gap as the elevator moves vertically. In this way, a similar positional indication of the displacement between the car and rail is obtained.

In any event, data is gathered for one or more runs of the elevator car which may, but need not, span its full operational range. The run may be at full, "contract" speed but need not be. This data may be processed as shown in FIG. 8 to generate one or more rail profiles.

Figure 9:
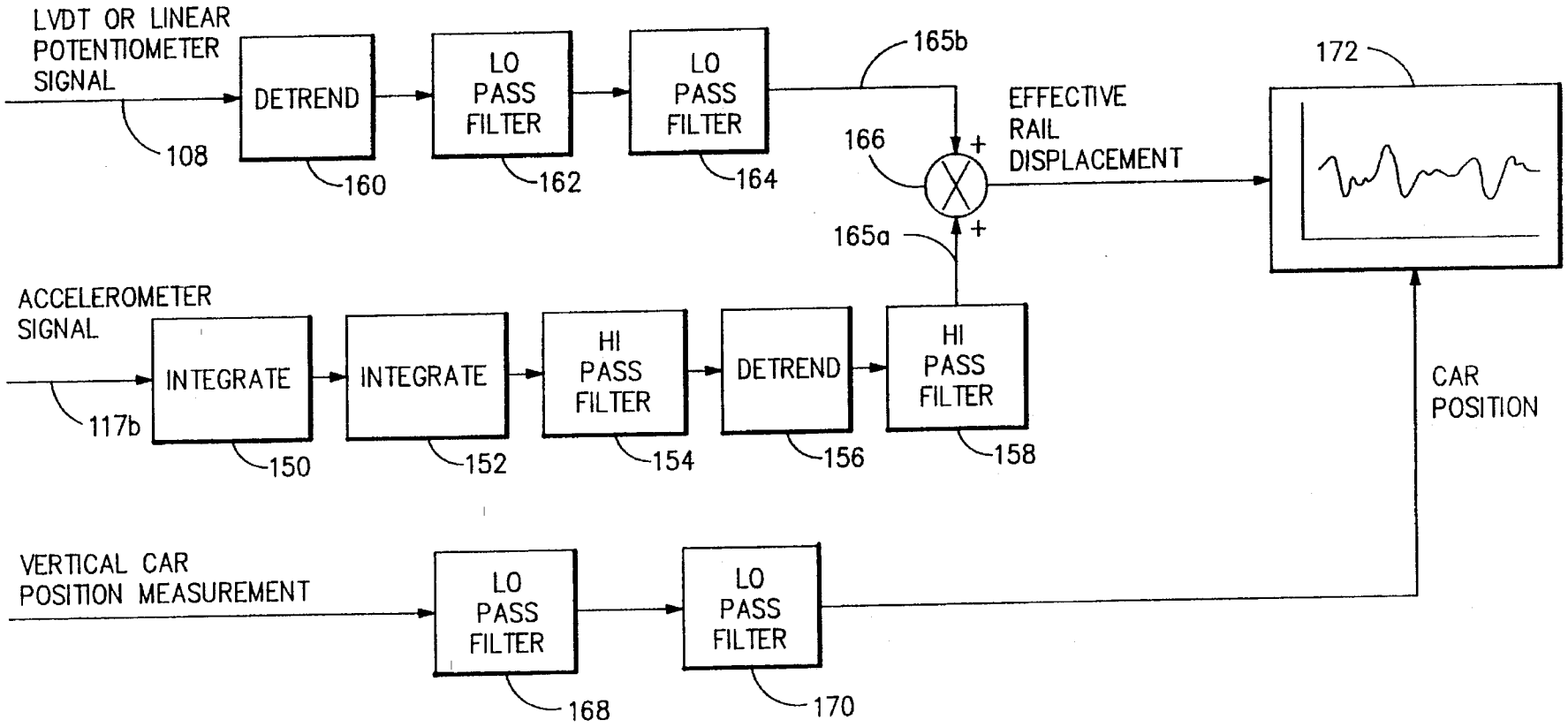
FIG. 9 is similar to FIG. 2 except more detailed.
Figure 10B:
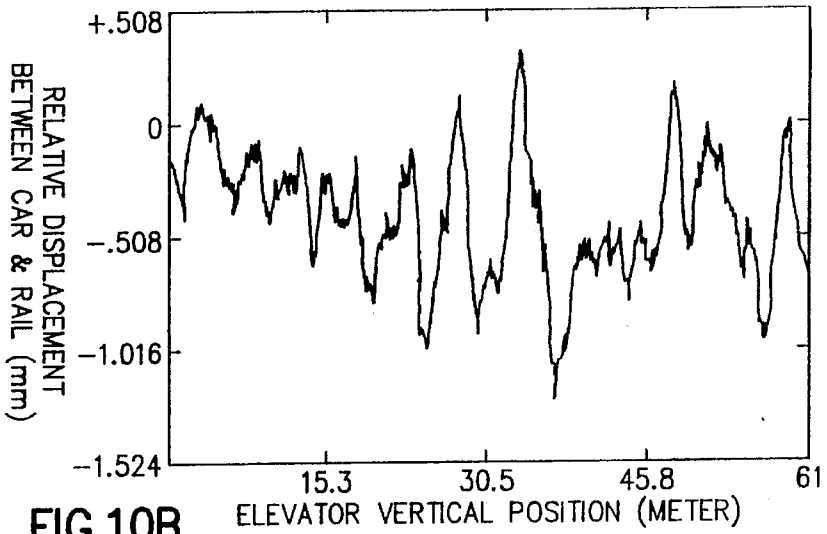
FIGS. 10(*a*), 11(*a*) & 12(*a*) show car acceleration vs. vertical position for a car load of 228 kilograms located, respectively, at the cab floor center, 94 centimeters to the left of center and 94 centimeters to the right of center, according to the present invention.
Figure 10D:
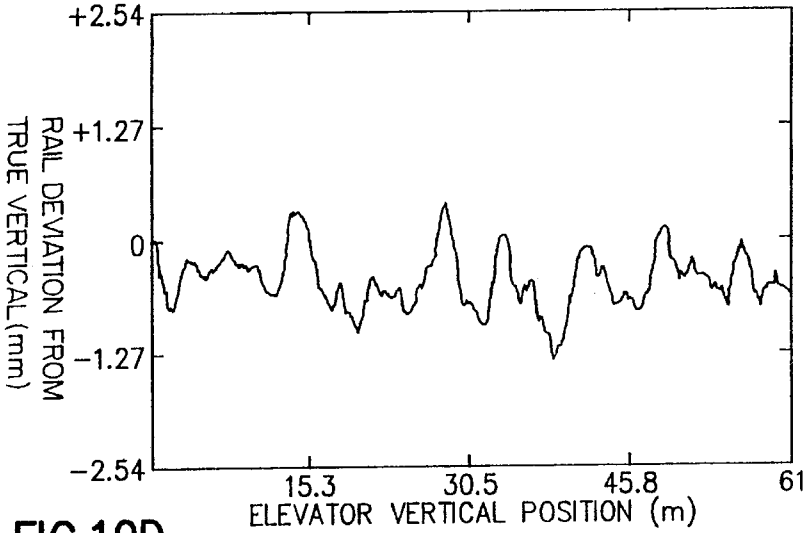
Figure 10A:
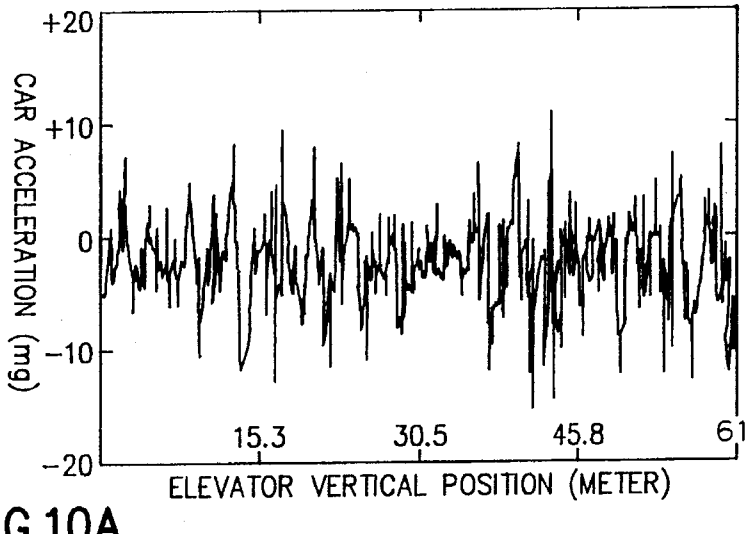
Figure 10C:
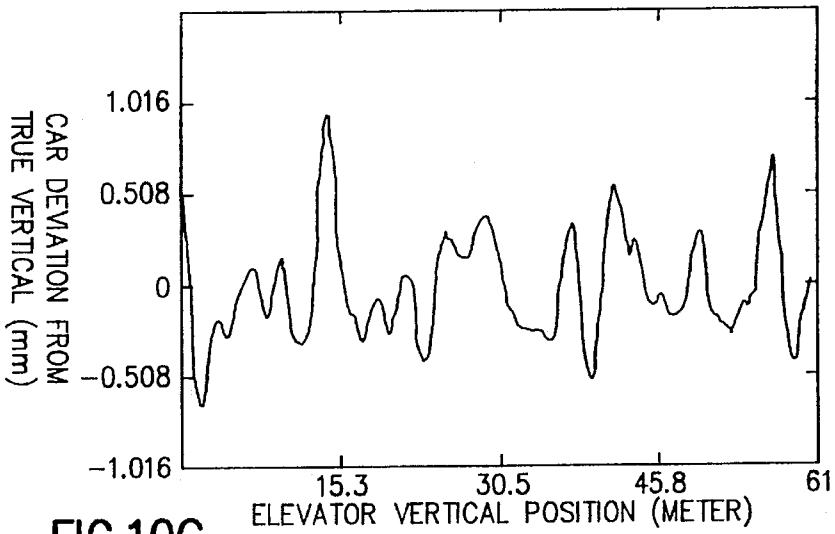
Figure 11B:
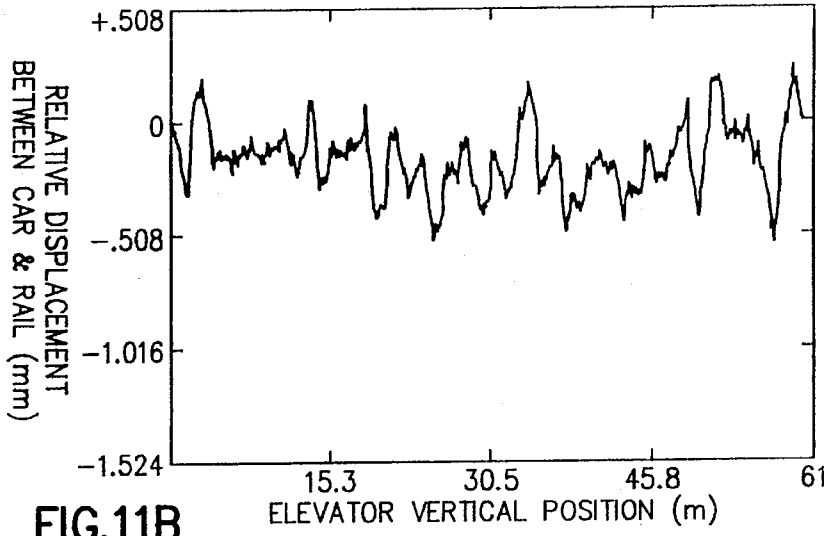
Figure 11D:
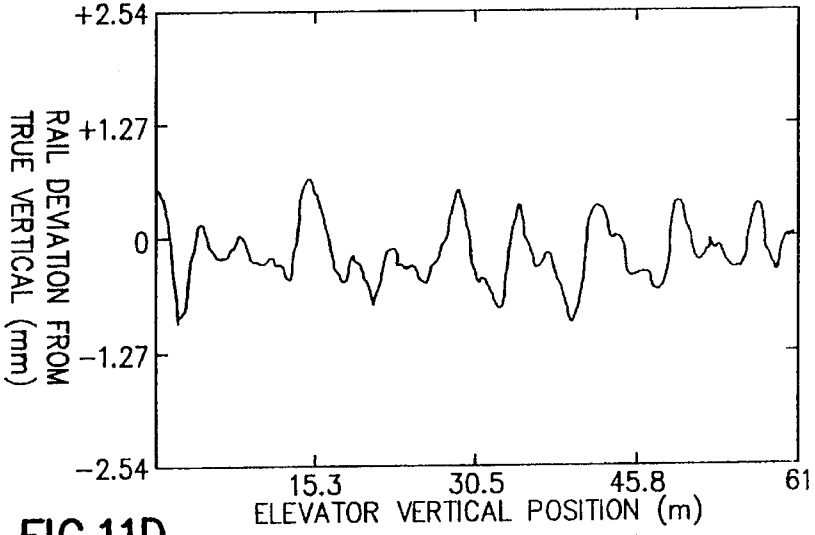
Figure 11A:
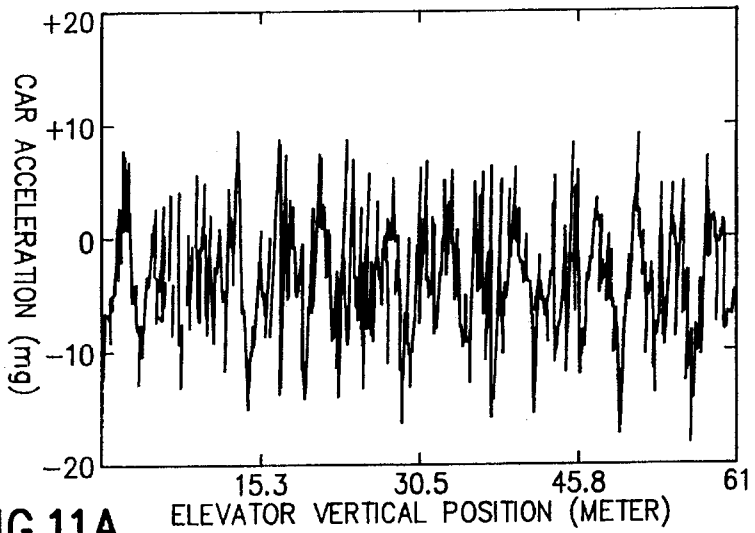
Figure 11C:
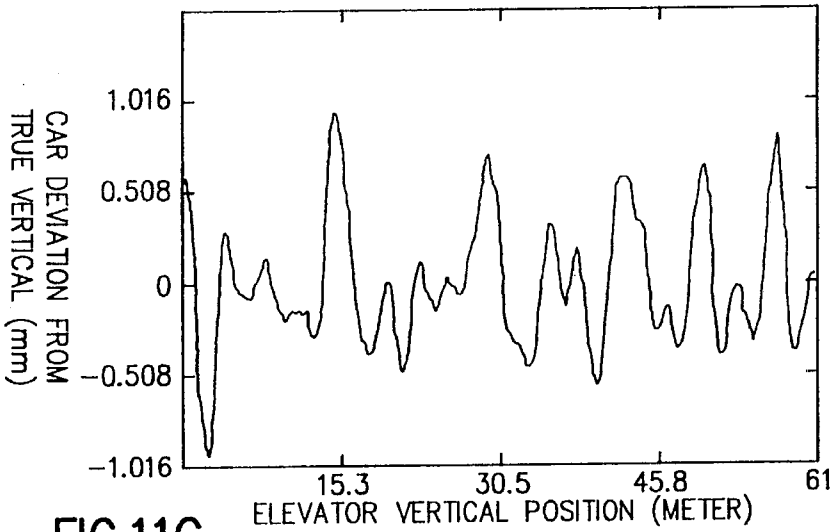
Figure 12B:
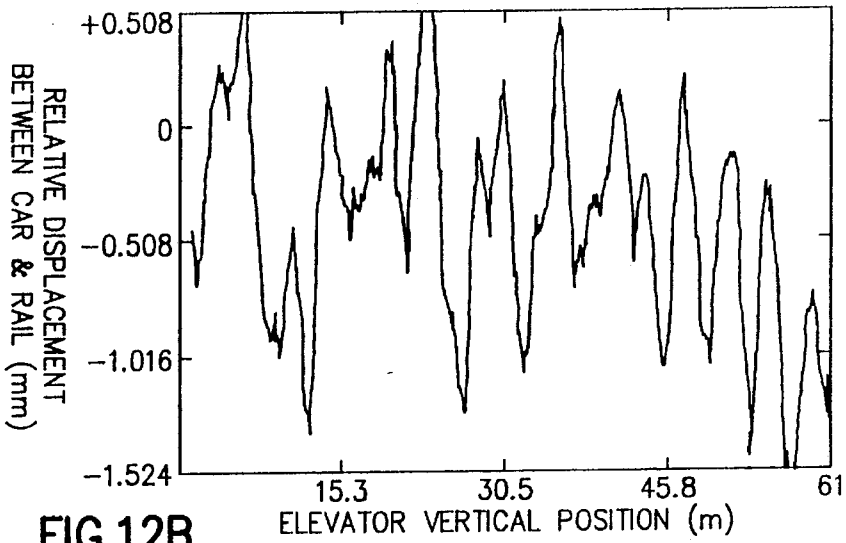
Figure 12D:
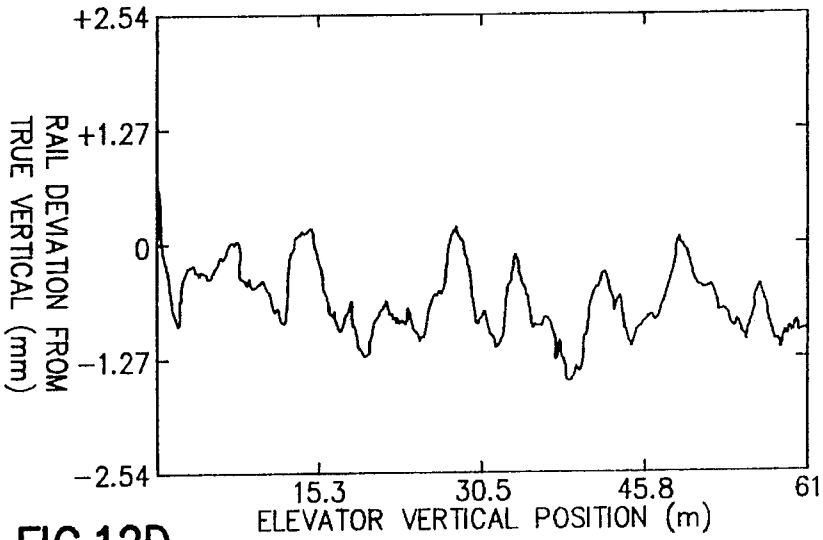
Figure 12A:
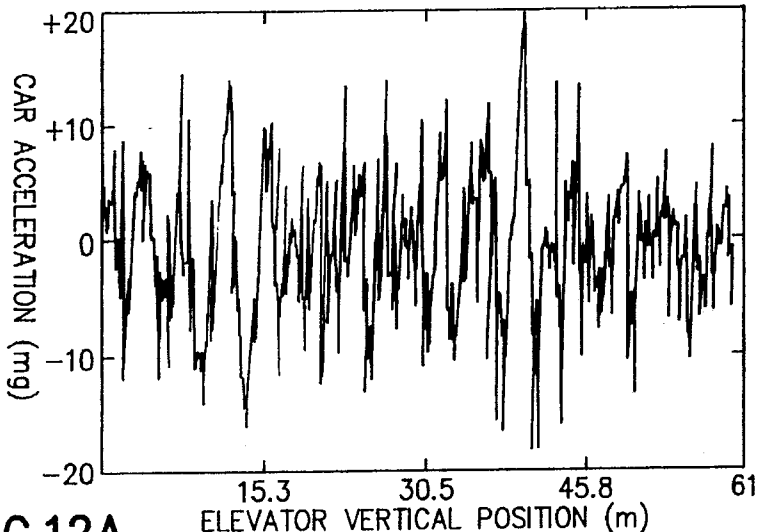
Figure 12C:
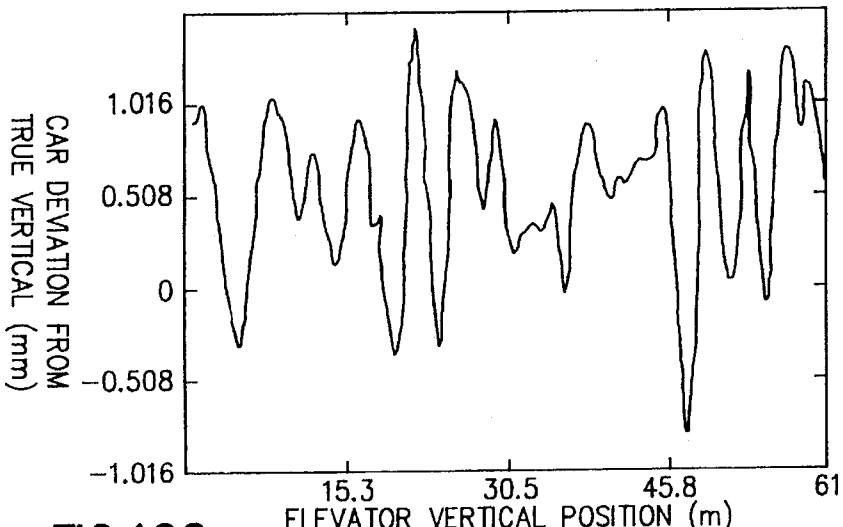

FIG. 9 is a more detailed illustration of the processing method shown in FIG. 2 for rail profile estimation in a single axis. This method of estimation may accomplished, for example, by executing a series of steps which are as follows and which may be set up to run in a flow chart for execution on the signal processor 109 in a manner similar to that shown in FIG. 8:

In both steps 150 & 152 integrate and detrend (subtract mean and first moment) the accelerometer output signal on line 117*b* twice;

In a step 154, high pass filter (third order Butterworth with 0.5 Hz breakpoint) the resultant signal, reversing time after the filtering operation to allow additional processing which will minimize phase shift or skew in data;

In a step 156, detrending the result of the filtering and reversal operation of step 154;

In a step 158, again high pass filter the resultant signal from step 156, again reversing time after the filtering operation to allow additional processing which will minimize phase shift or skew in data;

In a step 160, detrend the. LVDT or potentiometer signal on the line 108;

In steps 162, 164 low pass filter (third order Butterworth with 20.0 Hz breakpoint) this signal twice, reversing time after each filtering operation to allow additional processing which will minimize phase shift or skew in the LVDT data;

In a step 166, summing the processed accelerometer and LVDT signals to formulate an effective estimate of rail displacement as a function of time; and In steps 168, 170, low pass filter the vertical car position measurement twice, reversing time after each filtering operation to allow additional processing which will minimize phase shifts in this estimate of car position, creating in a step 172, a vertical position reference for the rail profile.

Table I summarizes the various functions that may be carried out in the above described steps as shown in FIG. 9:

TABLE I

| Function | Definition |
|---|---|
| F1 | Integrate<br>Detrend (subtract Mean and 1st moment) |
| F2 | High Pass Filter (3rd order Butterworth with 0.5 Hz breakpoint)<br>Reverse Data in Time |
| F3 | Detrend (subtract Mean and 1st moment) |
| F4 | Low Pass Filter (3rd order Butterworth with 20.0 Hz breakpoint)<br>Reverse Data in Time |

The multi-pass filtering technique described is one method of smoothing data and is discussed in some detail in *Applied Optimal Estimation,* Chapter 5, "Optimal Linear Smoothing", Gelb, A., editor MIT Press 1974. Other methods of data smoothing also exist, as discussed for example in *Optimal Filtering,* Chapter 7, "Smoothing of Discrete-Time Signals", Anderson, B. D. O., and J. B. Moore, Prentice-Hall, 1979, which could also be utilized.

The selection of filter break points in the smoothing algorithms of the rail estimation system logic is driven by the signal-to-noise characteristics of the sensors and the requirements of the rail estimate for enhancing ride quality. The lateral accelerometer measurements can be corrupted by two types of noise: (1) low frequency noise due to thermally induced electronic drifts and gravity vector misalignments and (2) high frequency electronic noise. Displacement transducers, such as the LVDTs or PPT, are subject to high frequency electronic noise. These parasitic noise effects, however, can be mitigated by filtering to result in rail estimates that are valid within a band of mid-range frequencies, such as the 0.5 to 20 Hz range. This selection of the filter range was determined to be the best compromise between noise reduction and rail estimation requirements based on a developed set of ride quality specifications (International Organization for Standardization (ISO), *Guide for the Evaluation of Human Exposure to Whole-Body Vibration,* Draft International Standard ISO/DIS 2631, Geneva, ISO, 1972), which indicates that humans are most affected by vibration in this frequency range.

The acceleration signals are filtered to remove the low frequency noise below 0.5 Hz. Double integration effectively removes the high frequency noise of those signals. The displacement signals are filtered to remove the high frequency noise above 20 Hz. The resultant rail estimate captures rail anomalies which are present in the frequency range to which humans are most susceptible.

FIGS. 10, 11 and 12 are plots of several of selected signals of FIG. 9, for a high-speed elevator installation (Hoistway No. 4 in the Otis Elevator Company's Bristol, Connecticut Test Tower) for loads of 228 kg at the center of the cab, 228 kg at 94 cm to the left of center and 228 kg at 94 cm to the right of center, respectively, each Figure containing:

(a) the acceleration signal on line 117*b* plotted against car vertical position;

(b) the car horizontal relative displacement signal (with respect to the rail) on line 108 plotted against car vertical position;

(c) the doubly integrated and filtered acceleration signal on line 165*a;*

(d) the sum of the signals on lines 165*a* and 165*b,* in each case being a rail profile prediction for the respective load positioning.

As will be apparent, for the three different runs represented by FIGS. 10, 11 & 12, the acceleration and relative displacement data are not repeatable. Thus, if one were to take the approach suggested by Otala, i.e., make an acceleration table, one could not base future behavior on the accelerations gathered during the learning run.

Moreover, as may be seen by comparing FIGS. 10(*c*), 11(*c*) & 12(*c*), even if one were to take Otala's idea one step further and doubly integrate the acceleration signal to at least create a dimensionally correct deviation table, such would not be usable as these plots are not repeatable either.

Only when we follow the teachings of the present invention by summing the signal from any one of the FIGS. 10(*b*), 11(*b*) or 12(*b*) with the respective signal from FIGS. 10(*c*), 11(*c*) or 12(*c*), may we obtain a repeatable rail profile as shown in FIGS. 10(*d*), 11(*d*) or 12(*d*).

Figure 13A:
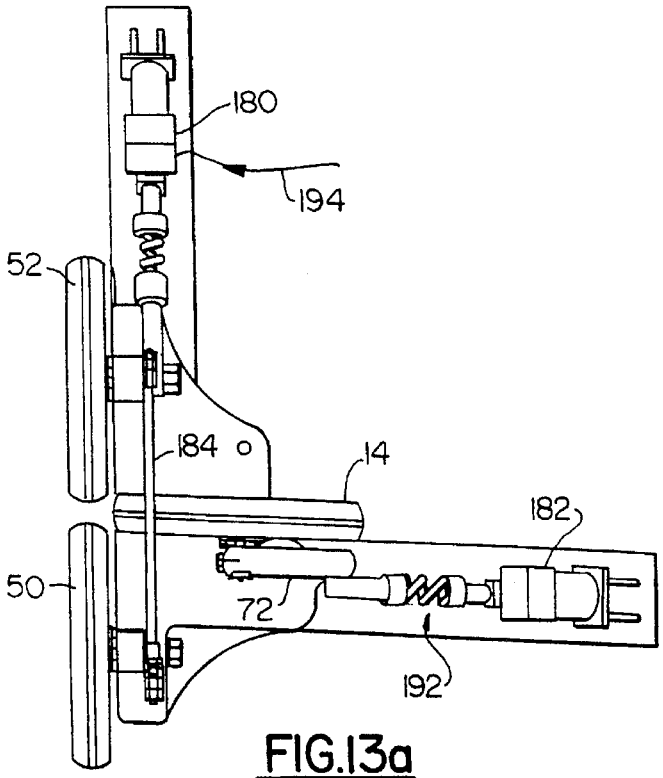
FIG. 13 shows in (a) a top view of a roller guide, such as that shown in FIG. 3, modified to be used in an open-loop active suspension system, (b) a side view of a roller guide of (a), and (c) shows a back view of the guide of (a)
Figure 13C:
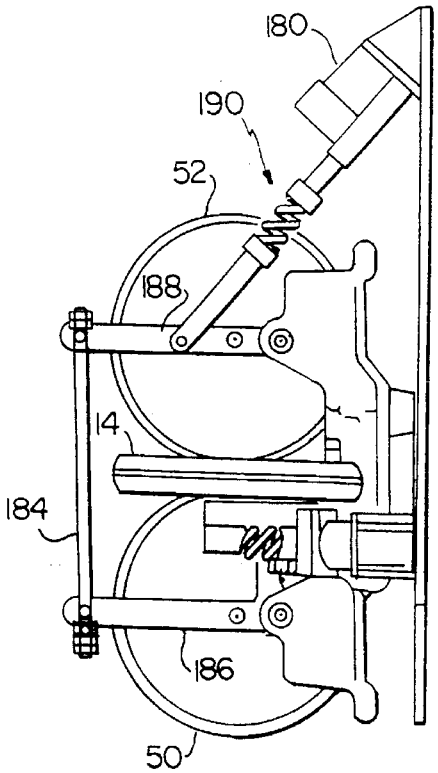
Figure 13B:
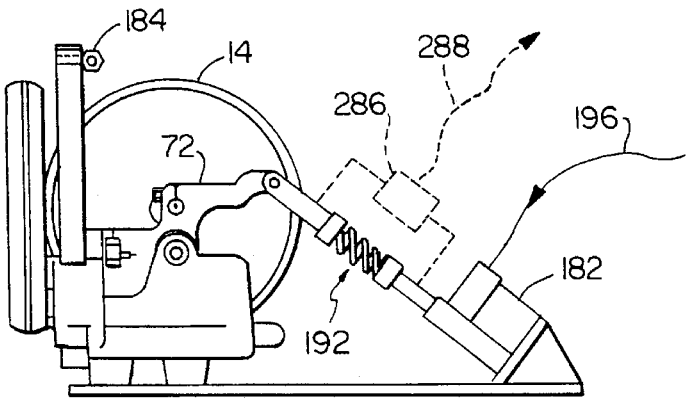

FIG. 13(*a*) shows a top view of a roller guide, such as the passive roller guide of FIG. 3 modified into an active roller guide. It will be observed, especially by viewing FIG. 13(*b*) and (*c*), which are respectively side and back views of the roller guide of FIG. 13(*a*), that the three vertical springs, e.g., spring 66 of FIG. 3, have all been removed and replaced by actuators 180, 182, and a tie rod 184 attached by means of vertical rods 186, 188 in lieu of rocker arms 62, 76, respectively. The tie rod assembly obviates the need for two separate front-to-back actuators.

The actuator 180 is connected to rod 188 through a spring 190 and, similarly, actuator 182 is connected to rocker arm 72 by a spring 192.

Open-loop control signals on lines 194, 196 are provided to actuators 180, 182, respectively, to control the front-to-back and side-to-side vibrations on one side of the car. A similar actuator is situated on the other side of the car for the other rail as shown in FIG. 15.

Figure 14:
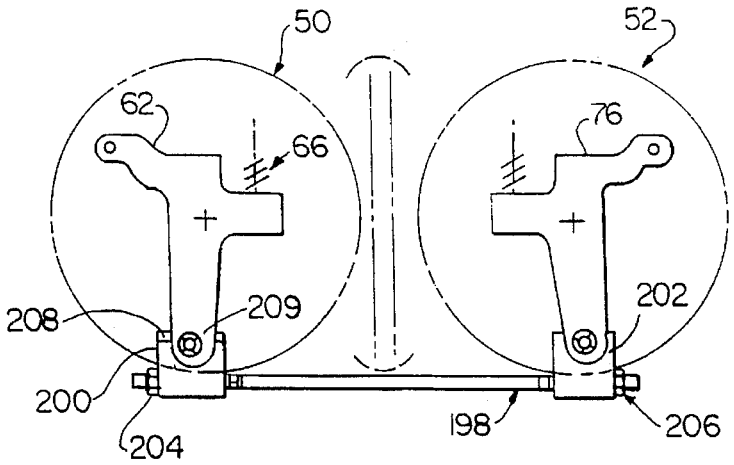
FIG. 14 shows another way to connect the front to back rollers.
Figure 15:
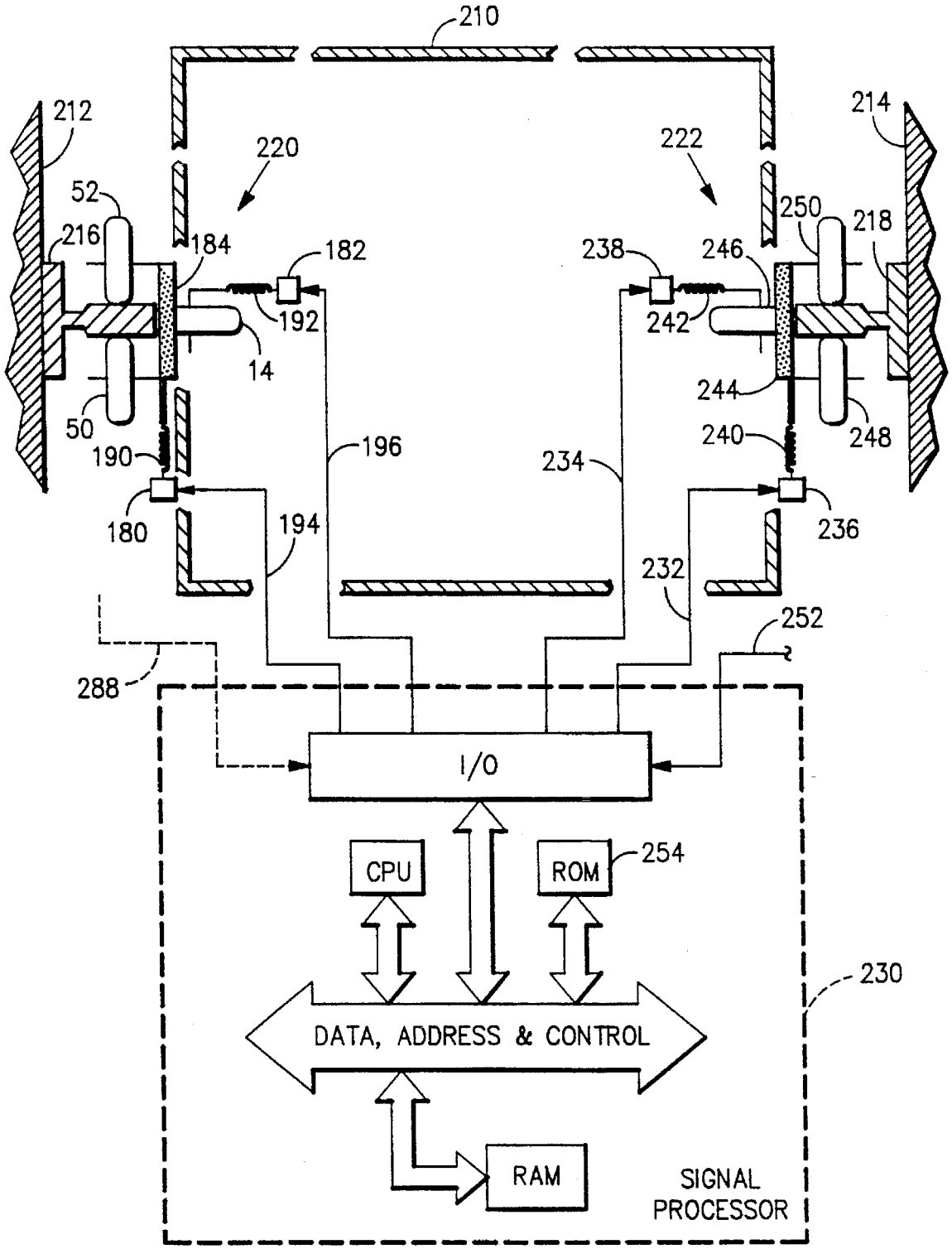
FIG. 15 shows an open-loop active suspension system, according to the present invention.

Before turning to FIG. 15 in detail, it will be observed in FIG. 14 that a tie rod 198, Otis Part No. 96BY1, could be connected to the bottom of the rocker arm 62, 76 by means of a pair of sleeves 200, 202, Otis Part No. 130HLI, with a ⅜ inch (0.95 cm) nut 204, 206 at each end. The sleeves could be attached by means of a bolt 208 and C-clamp 209 combination, Otis Part Nos. 172DRA and 177JP8.

Of course, for this case, the three vertical springs, e.g., spring 66, would also be removed and the actuator 180 and spring 190 would be attached, e.g., to the rocker arm 76 instead of putting in a special rod 188.

Returning now to FIG. 15, an elevator car 210 is shown in plan view (viewed from the bottom of the car) situated between opposite hoistway walls 212, 214, having rails 216, 218 attached thereto, respectively. A pair of roller guides 220, 222 are shown mounted on the bottom of the car, but may be mounted on the top as well. Passive guides may be mounted on top and active guides on the bottom as an alternative method.

The roller guides 220, 222 are shown in schematic form, each having similar parts with numerals for only one of them identified in conformance with the same numbers used for FIG. 3 and FIG. 13 (the guide 220 on the left, except if the actuator 180, spring 190 combination swapped from wheel 52 to wheel 50 for convenience of illustration).

A signal processor 230, which may be a general purpose signal processor similar to that shown in FIG. 7, provides the control signals on the lines 194, 196 to the actuators 180, 182, respectively. Similar control signals 232, 234 are provided to a similar pair of actuators 236, 238 connected by way of springs 240, 242 to a tie rod 244 and a rocker arm (not shown) for a wheel 246. Wheels 248, 250 are connected to the tie rod 244 by means of rods similar to those shown previously in connection with FIG. 13(*c*).

The signal processor 230 is responsive to an elevator vertical position signal on a line 252 for retrieving for each of the actuators, a signal indicative of rail deviation at that particular height for that particular axis of control. The signal processor 230 provides four separate actuation signals on lines 194, 196, 232, 234 to the respective actuators 180, 182, 236, 238 for providing a counteracting force acting on the car due to the rail irregularity previously learned to be at that particular vertical position.

Figure 16:
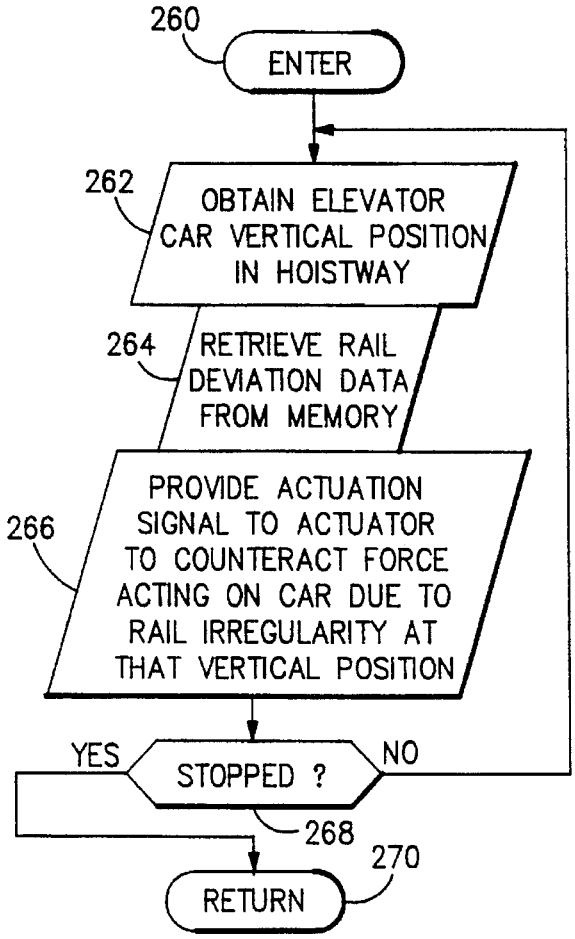
FIG. 16 shows a series of steps which may be carried out on the signal processor of FIG. 15 providing a smooth ride for the elevator car, as it moves up and down the hoistway.

As shown in FIG. 16, this process is a repetitive process which may be utilized while the car is in vertical motion by entering at a step 260 and executing the previously described steps of obtaining vertical position, as shown in a step 262, retrieving rail deviation data as shown in a step 264, and providing an actuation signal (for each axis controlled) to the particular actuator to counteract the expected rail-induced force to be acting on the car due to a rail irregularity at that particular vertical position, as shown in the step 266. A step 268 determines whether or not the car is still in vertical motion and, if so, continues repeating steps 262, 264, 266 to keep the car stabilized as long as the car is in motion. If not, return is made via a step 270 to a main program. The whole process may be re-entered at step 260 upon detecting the car starting up again.

The relative motion between the elevator car and its wheels must be constrained to prevent metal to metal contact between the rails and the elevator safeties. This condition is most affected by an imbalance in the elevator car which results in the transmission of excessive lateral forces into the passive suspension elements. Present elevator suspensions ensure that this amount of excursion in the wheel travel is prevented by incorporating adjustable rubber snubbers 280, 282, 284, as shown in FIG. 3, which are set to a gap less than that between the rail and the mechanical safeties.

The active rail compensation system can be made to prevent excessive car/wheel deflections during imbalances in the elevator car payload by sensing this deflection with, e.g., a sensor 286 that provides a signal on a line 288, as shown in phantom in FIG. 13(*b*), for each positioning actuator, and adjusting the command to the positioning actuators. This leveling action could be initiated as a low frequency adjustment to the actuators. For example, prior to car acceleration, a snapshot could be taken of the rail to wheel deflections and a signal correction signal could be sent to all actuators to center the car for the indicated loading condition. This would have the net effect of mitigating the car imbalance and thereby extend the allowable travel in each of the car suspension points.

Those skilled in the art will recognize that one could, instead of integrating the sensed acceleration signals during the learning run and storing same as deviation values, store the acceleration signals and integrate them when needed. Similarly, the relative displacement sensor disclosed herein for measuring the distance between the car and rail could be replaced by another type of sensor such as an accelerometer which could be conditioned later to obtain the equivalent displacement information.

Although the invention has been shown and described with respect to a best mode embodiment thereof, it should be understood by those skilled in the art that the foregoing and various other changes, omissions and deletions in the form and detail thereof may be made therein without departing from the spirit and scope of this invention.

I claim:

1. Apparatus for reducing horizontal movement of an elevator car as it moves on opposed guide rails in a hoistway, comprising:

actuator means, responsive to an actuator drive signal, for horizontally adjusting the position of the elevator car with respect to the opposed guide rails; and signal processing means, responsive to a vertical position signal indicative of a vertical position of the elevator car in the hoistway, for providing the actuator drive signal, wherein said signal processing means includes memory means containing information indicative of a sensed horizontal displacement of the elevator car in relation to the opposed guide rails and a sensed horizontal acceleration of the elevator car and that is stored at an address in said memory according to the vertical position of the elevator car in the hoistway, and wherein the actuator drive signal is dependent upon the vertical position of the elevator car, the sensed horizontal displacement of the elevator car in relation to the opposed guide rails and the sensed horizontal acceleration of the elevator car.

2. Apparatus according to claim 1, further comprising:

sensing means for providing a sensed information signal including both a sensed horizontal displacement signal indicative of the sensed horizontal displacement of the elevator car in relation to the opposed guide rails and a sensed horizontal acceleration signal indicative of the sensed horizontal acceleration of the elevator car; and wherein said signal processing means is responsive during a rail profile run to the sensed information signal, for providing the sensed horizontal displacement signal and the sensed horizontal acceleration signal for storage at said address in the memory means according to the vertical position signal.

3. The apparatus of claim 1, further comprising:

sensing means for providing a sensed information signal including both a sensed horizontal displacement signal indicative of the sensed horizontal displacement of the elevator car in relation to the opposed guide rails and a sensed horizontal acceleration signal indicative of the sensed horizontal acceleration of the elevator car;

wherein said signal processing means further comprises:

double integration means, responsive to the sensed horizontal acceleration signal, for providing a doubly integrated sensed horizontal acceleration signal; and a summing means, responsive the sensed horizontal displacement signal, and further responsive to the doubly integrated sensed horizontal acceleration signal, for providing a summed signal for storage at said address in the memory means according to the vertical position signal.

4. The apparatus of claim 1, further comprising:

sensing means for providing a sensed information signal including both a sensed horizontal displacement signal indicative of the sensed horizontal displacement of the elevator car in relation to the opposed guide rails and a sensed horizontal acceleration signal indicative of the sensed horizontal acceleration of the elevator car;

wherein said signal processing means includes:

means, responsive to said sensed horizontal acceleration signal, for twice integrating and detrending said sensed horizontal acceleration signal for providing a twice-integrated and detrended acceleration signal;

means, responsive to said twice-integrated and detrended acceleration signal, for first high-pass filtering and reversing in time said twice-integrated and detrended acceleration signal for providing a once high-pass filtered acceleration signal;

means, responsive to said once high-pass filtered acceleration signal, for detrending the once high-pass filtered acceleration signal for providing a detrended once high-pass filtered signal;

means, responsive to said detrended once high-pass filtered signal, for twice high-pass filtering and reversing in time said detrended once high-pass filtered signal for providing a twice-filtered acceleration signal;

means, responsive to said sensed horizontal displacement signal, for detrending said sensed horizontal displacement signal, for providing a detrended car position signal;

means, responsive to said detrended car position signal, for twice low-pass filtering and reversing in time said detrended car position signal for providing a twice-filtered car position signal; and summing means, responsive to said twice-filtered car position signal and said twice-filtered acceleration signal, for summing said twice-filtered acceleration signal and said twice-filtered car position signal for providing a summed twice-filtered car position and acceleration signal for storage at said address in the memory means according to the vertical position signal.

5. An elevator control system, comprising:

(a) elevator car vertical position sensing means, responsive to a vertical position of the elevator car along opposed guide rails, for providing elevator car vertical position signals;

(b) learned-rail memory means, responsive to learned-rail memory read signals, for providing learned-rail information signals containing learned information about a sensed horizontal displacement of the elevator car in relation to opposed guide rails and a sensed horizontal acceleration of the elevator car and being indexed according to the vertical position of the elevator car along the opposed guide rails;

(c) elevator car control means, responsive to the elevator car vertical position signals, for providing learned-rail memory read signals, and further responsive the learned-rail information signals, for providing horizontal adjustment control signals; and (d) actuator means, responsive to the horizontal adjustment control signals, for adjusting horizontally the elevator car in relation to the opposed guide rails in the elevator hoistway, wherein the horizontal adjustment control signals are dependent upon the vertical position of the elevator car along opposed guide rails, the sensed horizontal displacement of the elevator car in relation to the opposed guide rails and the sensed horizontal acceleration of the elevator car.

6. A method for controlling an elevator, comprising the steps of:

providing elevator car vertical position signals with elevator car vertical position indicating means depending on a vertical position of the elevator car along opposed guide rails in a hoistway;

providing, in response to the elevator car vertical position signals, learned-rail memory read signals from an elevator car control means;

retrieving, in response to the learned-rail memory read signals, learned-rail information signals which contain learned information about a sensed horizontal displacement of the elevator car in relation to opposed guide rails and a sensed horizontal acceleration of the elevator car, the learned-rail information signals being indexed according to the vertical position of the elevator car along the opposed guide rails from a learned-rail memory means;

providing horizontal adjustment control signals from the elevator car control means in response to the learned-rail information signals, the horizontal adjustment control signals depending upon the vertical position of the elevator car along the opposed guide rails, the sensed horizontal displacement of the elevator car in relation to the opposed guide rails and the sensed horizontal acceleration of the elevator car; and adjusting the elevator car horizontally in relation to the opposed guide rails in the elevator hoistway with actuator means in response to the horizontal adjustment control signals.

* * * * *